US010669860B2

(12) United States Patent
Lee

(10) Patent No.: US 10,669,860 B2
(45) Date of Patent: Jun. 2, 2020

(54) GAS TURBINE BLADE

(71) Applicant: DOOSAN HEAVY INDUSTRIES & CONSTRUCTION CO., LTD., Changwon-si, Gyeongsangnam-do (KR)

(72) Inventor: Ik Sang Lee, Suwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 109 days.

(21) Appl. No.: 15/979,396

(22) Filed: May 14, 2018

(65) Prior Publication Data

US 2019/0078442 A1 Mar. 14, 2019

(30) Foreign Application Priority Data

Sep. 11, 2017 (KR) ..... 10-2017-0115646

(51) Int. Cl.
*F01D 5/18* (2006.01)

(52) U.S. Cl.
CPC ..... *F01D 5/186* (2013.01); *F05D 2220/32* (2013.01); *F05D 2240/30* (2013.01);
(Continued)

(58) Field of Classification Search
CPC ..... F01D 5/186; F05D 2260/2212; F05D 2260/22141
See application file for complete search history.

(56) References Cited

U.S. PATENT DOCUMENTS 8,092,177 B2 * 1/2012 Liang ..... F01D 5/186 416/231 R
8,480,366 B2 * 7/2013 Malecki ..... F01D 5/189 415/1
(Continued)

FOREIGN PATENT DOCUMENTS

JP H10-89005 A 4/1998
JP 4845957 B2 12/2011
KR 20050101639 A 10/2005

OTHER PUBLICATIONS

Korean Office Action issued by the Korean Intellectual Property Office dated Jul. 16, 2018 in connection with Korean Patent Application No. 10-2017-0115646.
(Continued)

*Primary Examiner* — Ninh H. Nguyen
(74) *Attorney, Agent, or Firm* — Ivenstone Patent, LLC

(57) ABSTRACT

A turbine blade for a gas turbine employs film cooling to enhance cooling performance. The turbine blade includes an outer surface; and at least one film cooling hole formed in the outer surface, each film cooling hole including a cooling channel extending inside the turbine blade to guide cooling air toward the outer surface, an outlet communicating with one end of the cooling channel to discharge cooling air to the outer surface, and a plurality of protrusions formed on an inside surface of the outlet and arranged along a longitudinal direction of the outlet. The protrusions protrude inwardly to a predetermined height from the inside surface of the outlet and extend from the cooling channel to the outer surface, in an arrangement of at least one protrusion formed on an inside wall of the outlet or on each of two opposing inside walls of the outlet.

18 Claims, 17 Drawing Sheets

(52) U.S. Cl.
CPC .... *F05D 2250/14* (2013.01); *F05D 2250/141* (2013.01); *F05D 2250/324* (2013.01); *F05D 2260/202* (2013.01); *F05D 2260/2212* (2013.01)

(56) References Cited

U.S. PATENT DOCUMENTS

| | | | | |
|---|---|---|---|---|
| 8,684,691 | B2 * | 4/2014 | Lee | F01D 5/20 416/224 |
| 8,733,111 | B2 * | 5/2014 | Gleiner | F23R 3/06 415/115 |
| 2009/0304494 | A1 | 12/2009 | Strock et al. | |
| 2009/0304499 | A1 | 12/2009 | Strock et al. | |
| 2016/0201474 | A1 * | 7/2016 | Slavens | F01D 5/186 60/806 |

OTHER PUBLICATIONS

A Korean Office Action dated Jan. 8, 2019 in connection with Korean Patent Application No. 10-2017-0115646 which corresponds to the above-referenced U.S. application.

* cited by examiner

[FIG. 1]
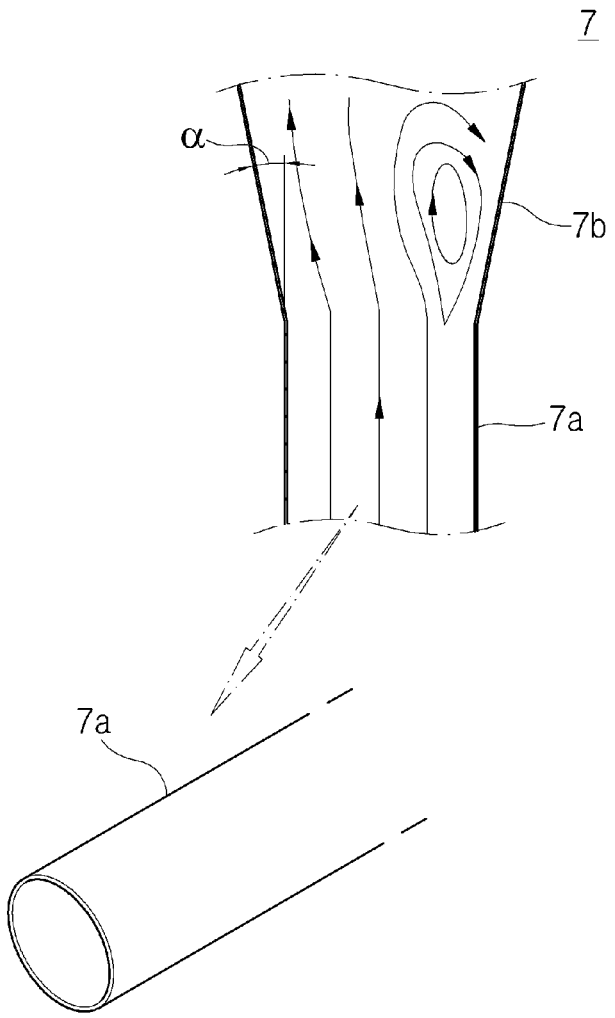
Related Art

[FIG. 2]
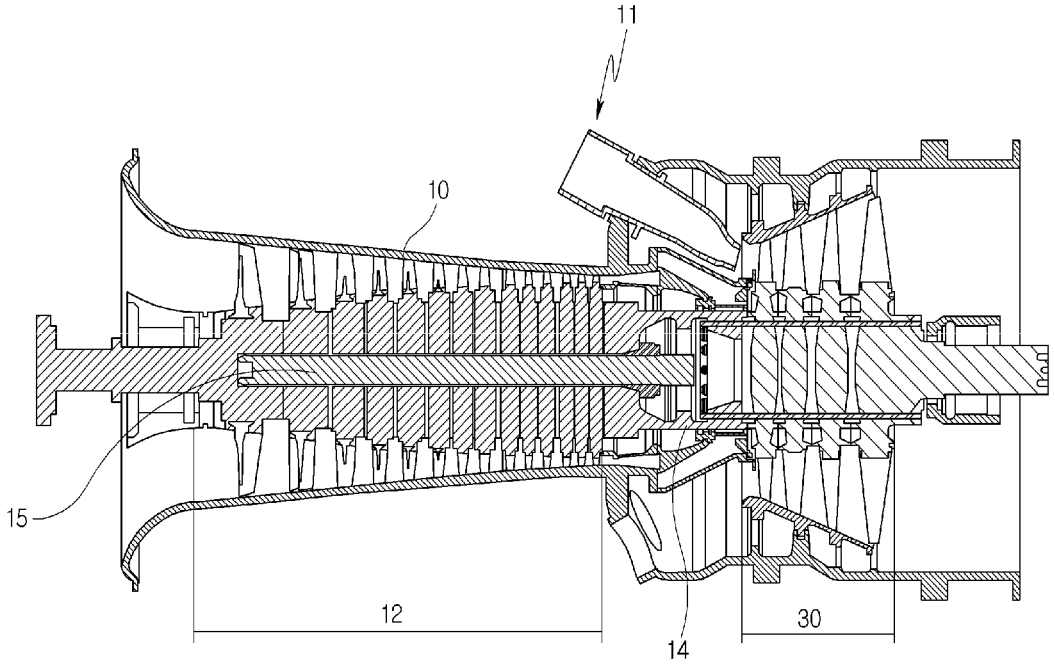

[FIG. 3]
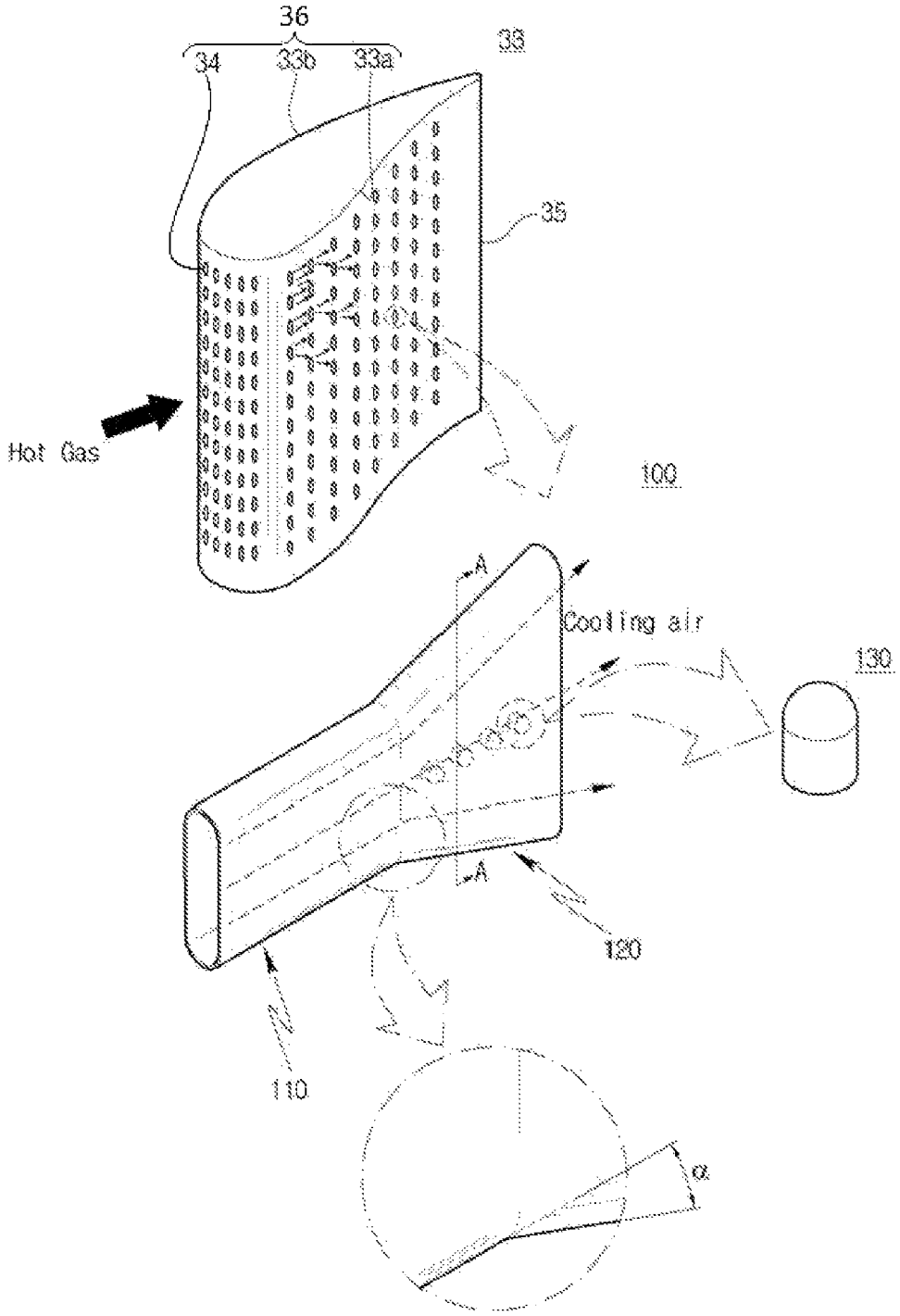

[FIG. 4]
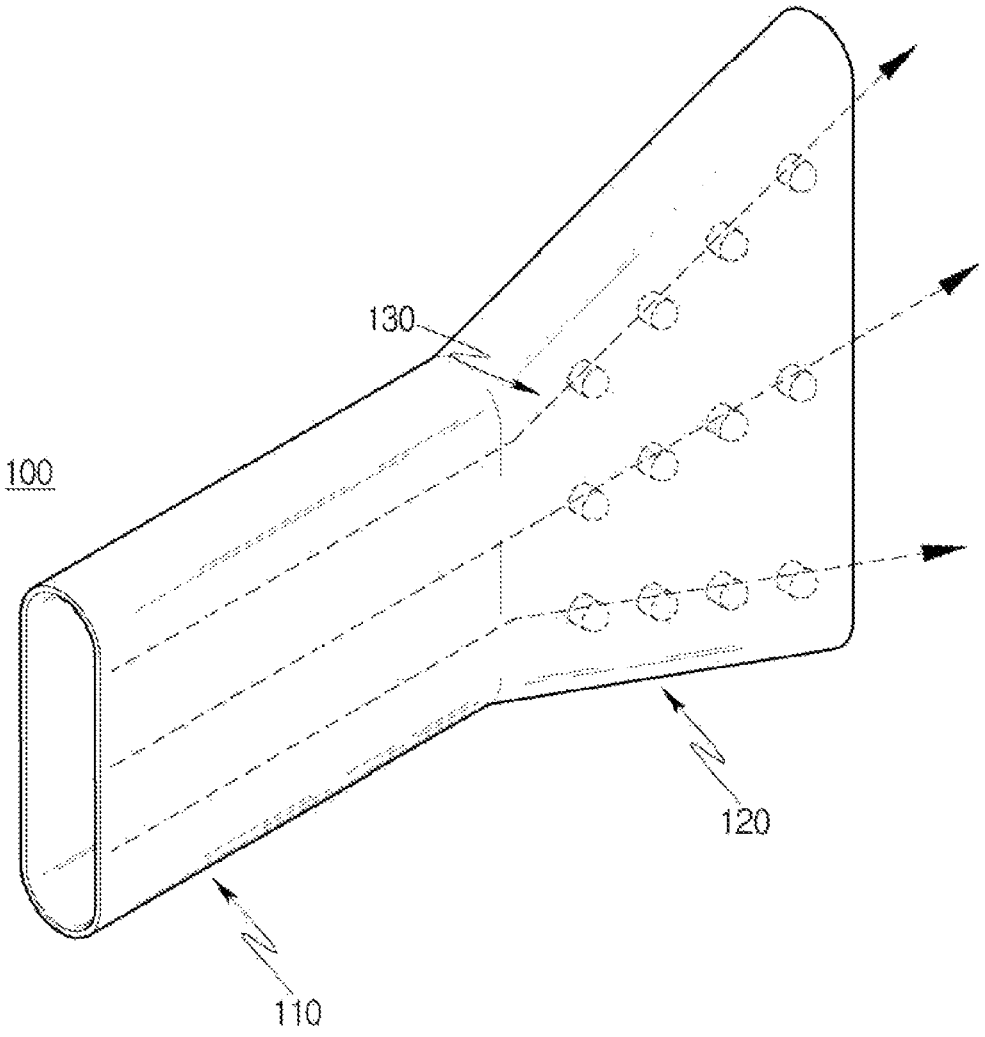

[FIG. 5]
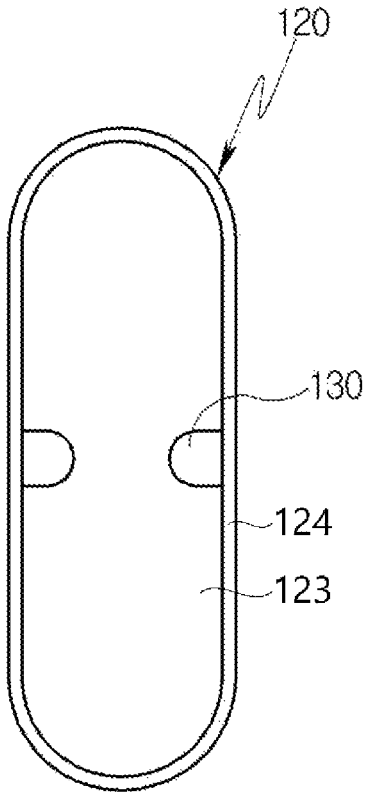

[FIG. 6]
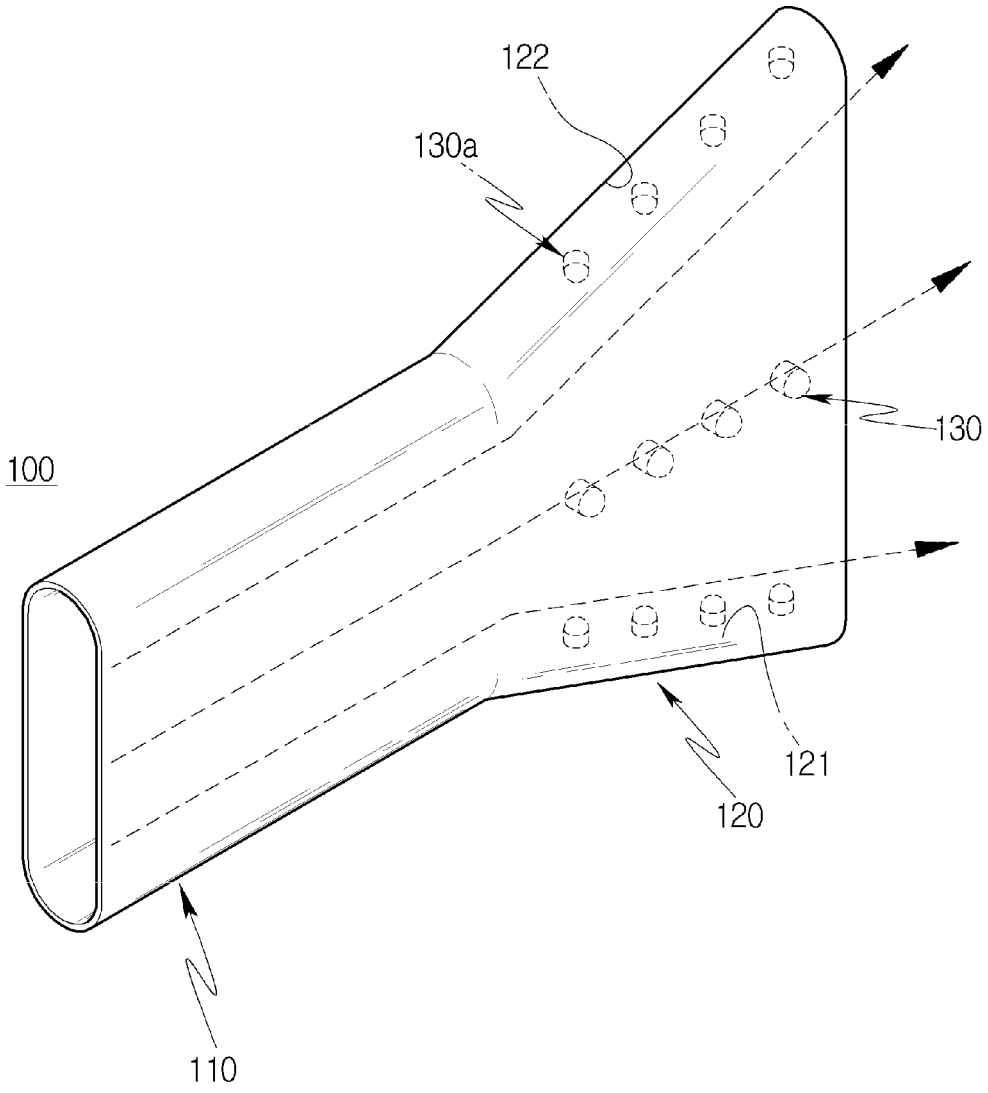

[FIG. 7]
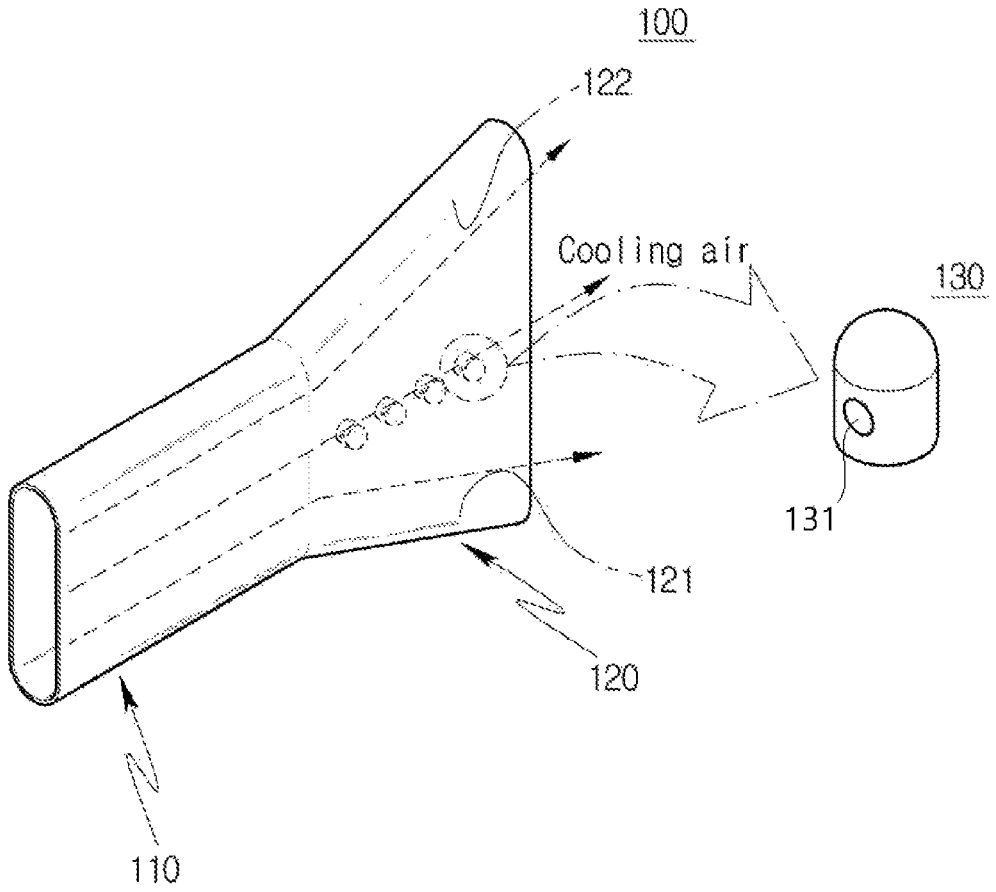

[FIG. 8]
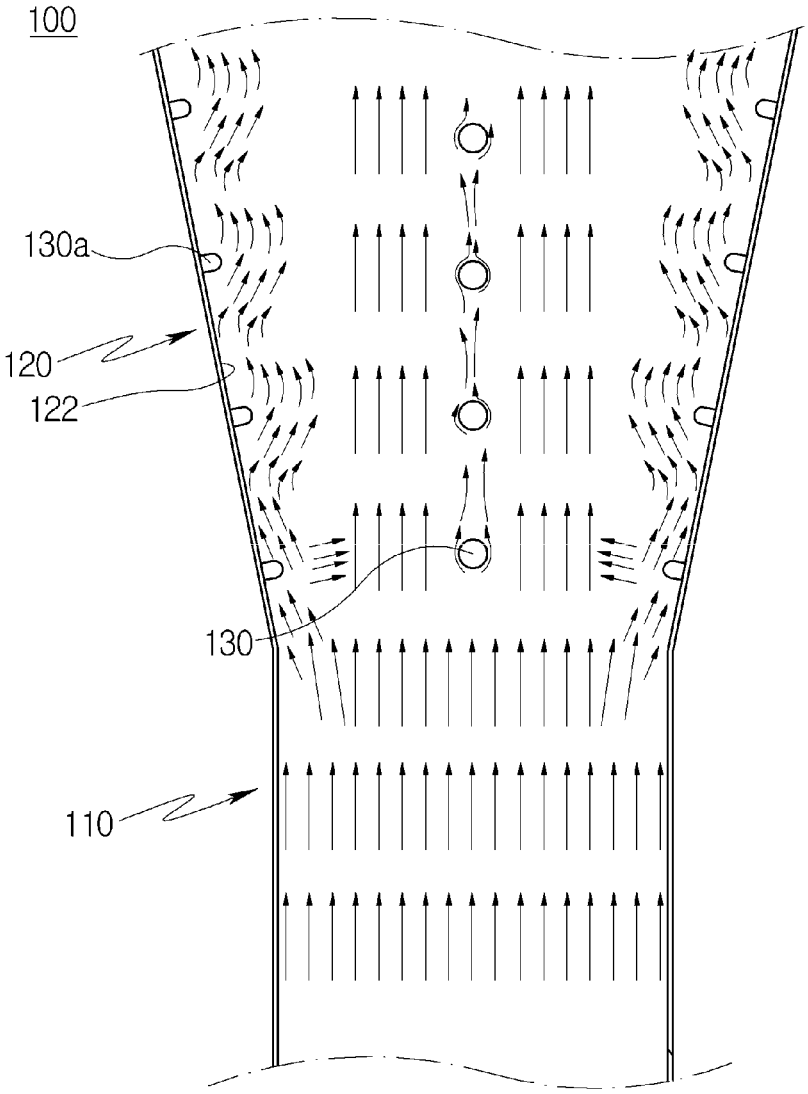

[FIG. 9]
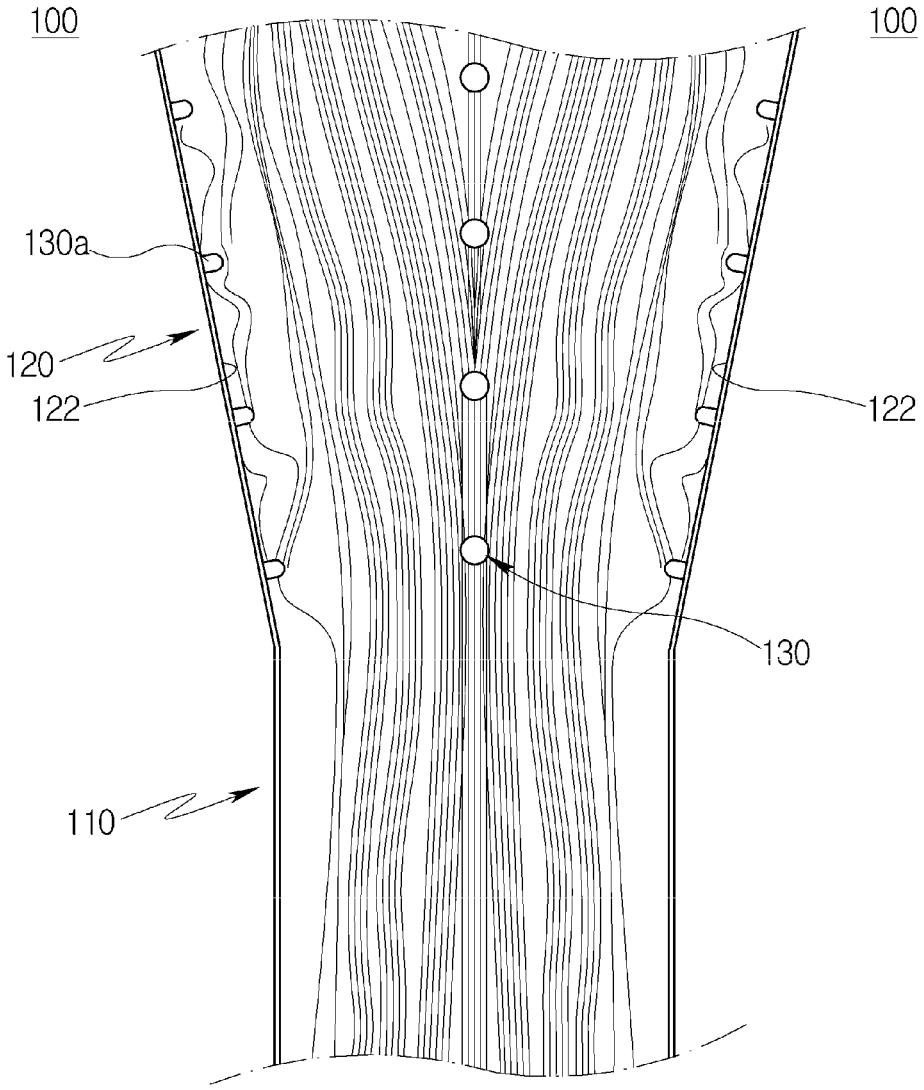

[FIG. 10]
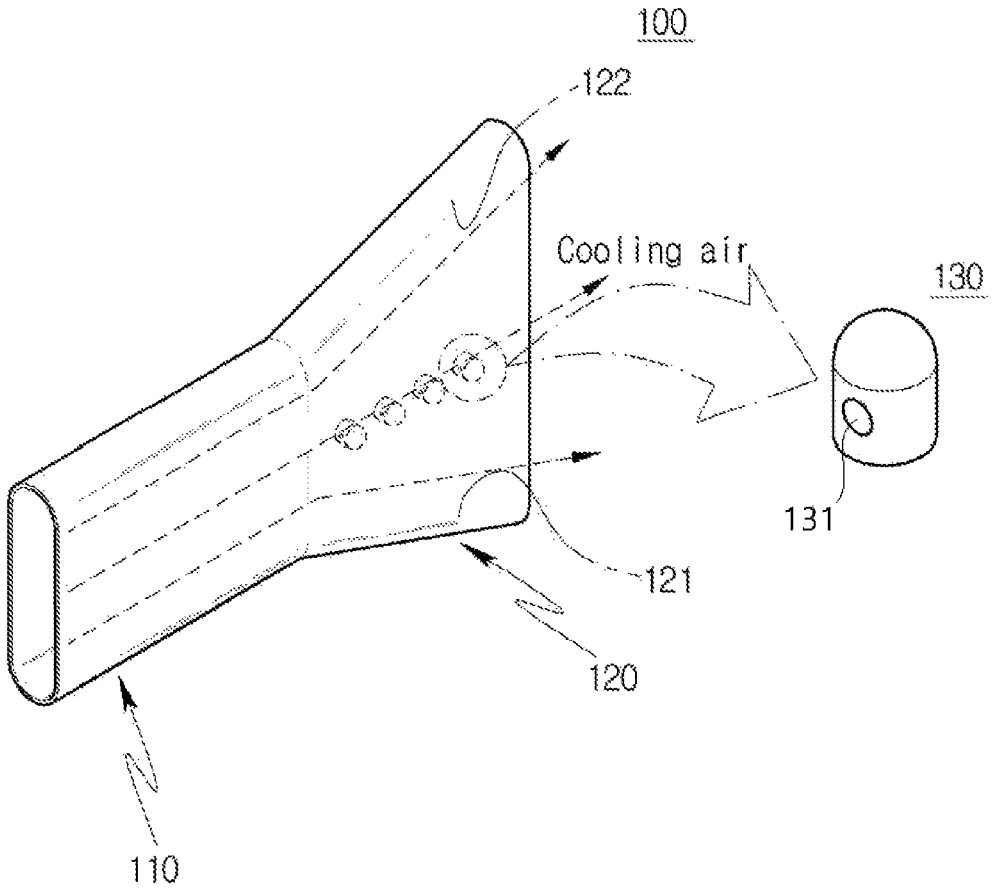

[FIG. 11]
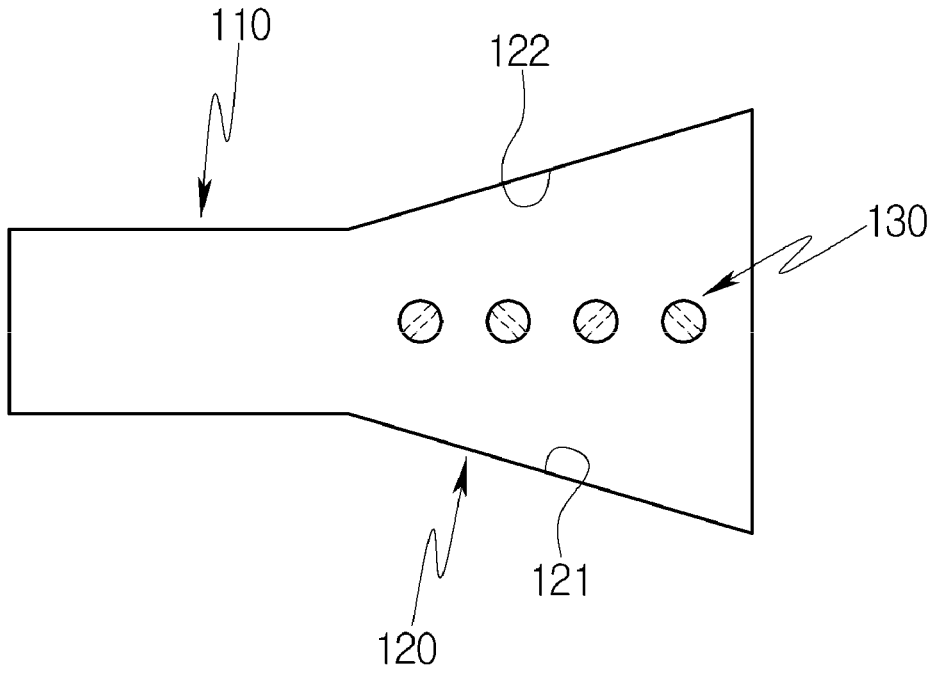

[FIG. 12]
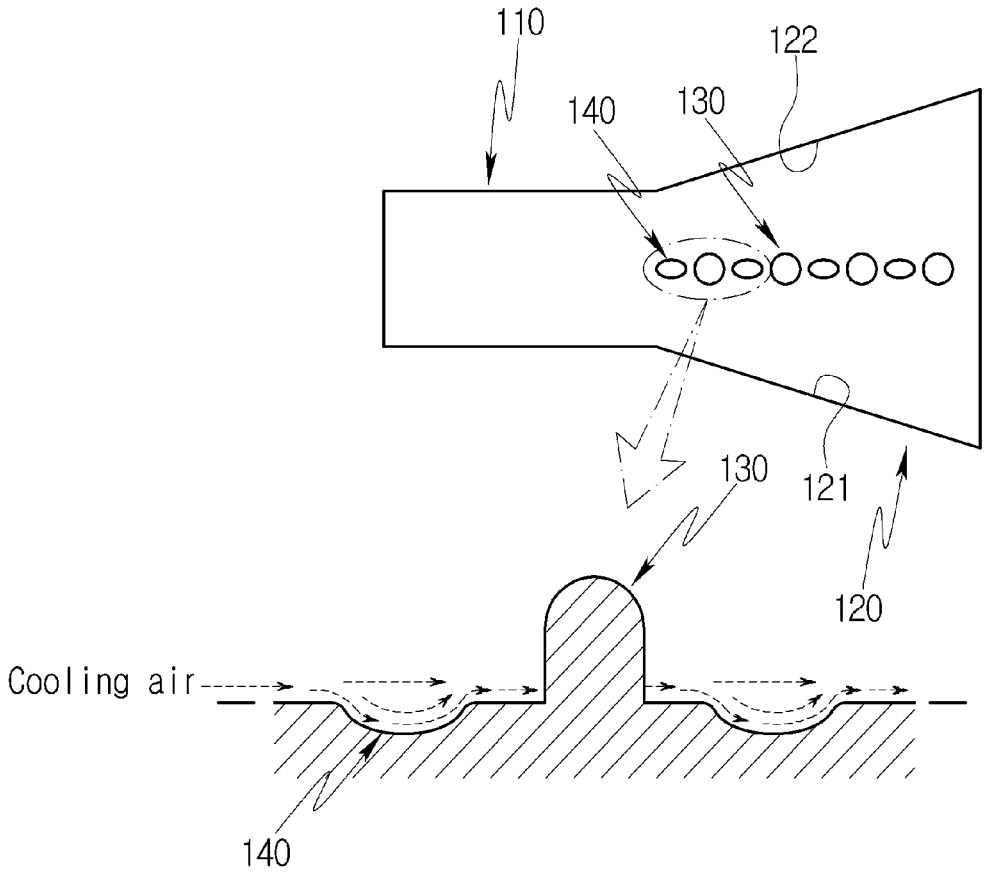

[FIG. 13]
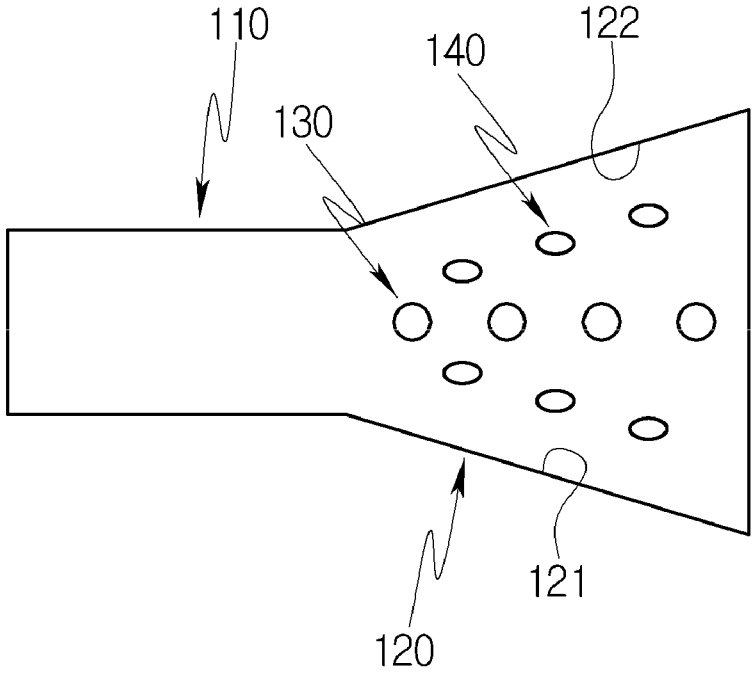

[FIG. 14]
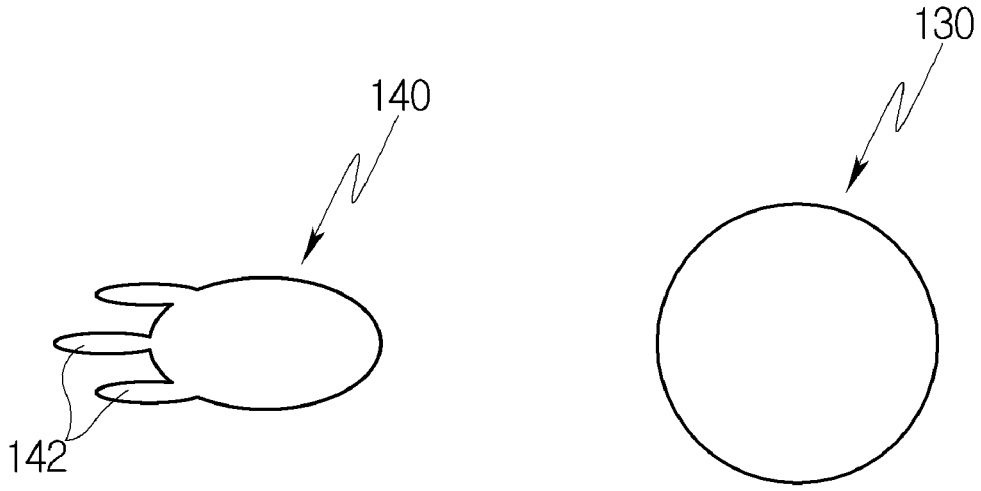

[FIG. 15]
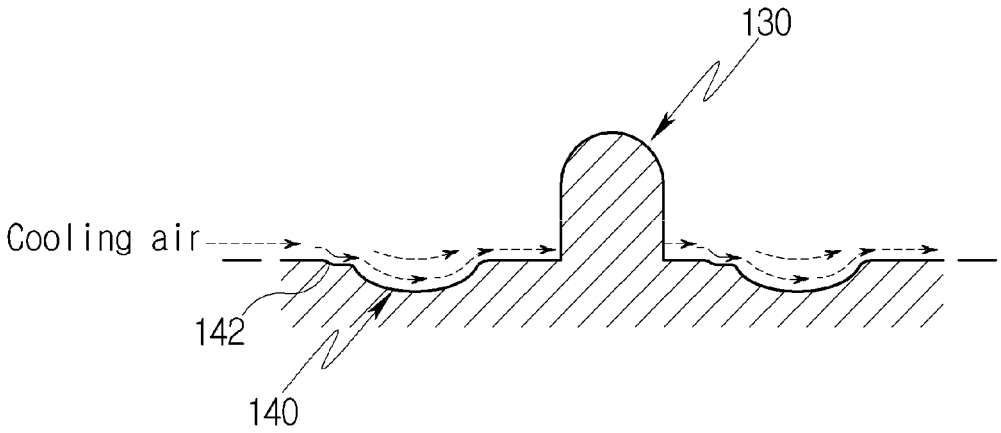

[FIG. 16]
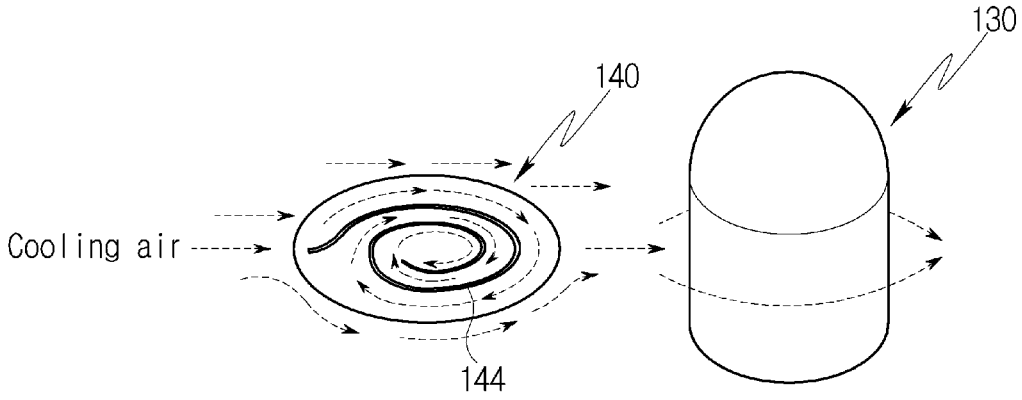

[FIG. 17]
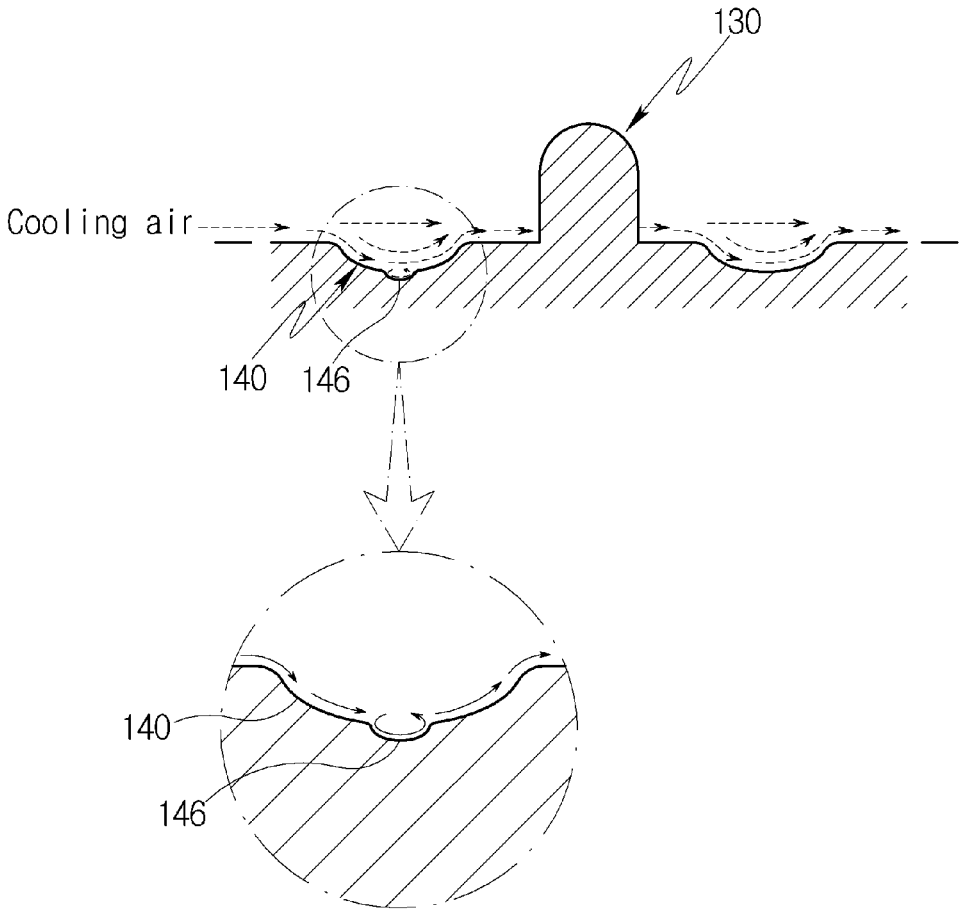

GAS TURBINE BLADE

CROSS-REFERENCE TO RELATED APPLICATIONS

This application claims priority to Korean Patent Application No. 10-2017-0115646, filed on Sep. 11, 2017 the disclosure of which is incorporated herein by reference in its entirety.

BACKGROUND OF THE DISCLOSURE

Field of the Disclosure

The present invention relates to a gas turbine blade provided in a gas turbine, and more particularly, to a gas turbine blade employing film cooling.

Description of the Related Art

A gas turbine is a type of an internal combustion engine that converts thermal energy into mechanical energy. A high-temperature, high-pressure combustion gas is generated by mixing fuel with air compressed at a high pressure in a compressor and combusting the mixture. The gas is discharged into a turbine, which acts against a series of turbine blades and thus rotates the turbine. A widely used turbine configuration includes a plurality of turbine rotor disks each having an outer circumferential surface on which a plurality of gas turbine blades are arranged in multiple stages. The combustion gas passes through each stage of arranged turbine blades. In doing so, the turbine blades are subject to very high temperatures, which jeopardizes the integrity of the turbine components under high pressure. This especially affects the turbine blades.

To counteract these effects and to avert failure of turbine blades in gas turbine engines resulting from excessive operating temperatures, gas turbine blades generally employ a film cooling technique which has been applied blade designs in order to cool the blade surfaces. In film cooling, relatively cool air obtained from the compressor is ducted to internal chambers of the turbine blades and discharged through small holes provided in the blade walls. This air provides a thin, cool, insulating blanket along the external surfaces of the turbine blade.

FIG. 1 shows two views of a film cooling hole 7 formed in a contemporary turbine blade (not shown) which has a plurality of such film cooling holes arranged across outer surfaces of the turbine blade. Each film cooling hole 7 discharges cooling air onto blade surfaces that are adjacent to the hole's outlet.

The film cooling hole 7 includes an inlet 7*a* having a circular cross-section through which flows the cooling air supplied to the interior of the turbine blade, and an extension portion 7*b* extending from the inlet 7*a* to the turbine blade surface (not shown) where the cooling air is discharged. The extension portion 7*b* performs a diffusion of the cooling air to be discharged, and a specific diffusion angle $\alpha$ is formed with respect to the inlet 7*a*. This diffusion is to enhance the effect of a large amount of cooling air being supplied to the surface through the extension portion 7*b*. However, as the diffusion angle $\alpha$ increases, a separation phenomenon is unevenly caused inside the expansion portion 7*b*, whereby the flow of cooling air onto the blade surface is inconsistent and uneven.

Therefore, the cooling effect in a gas turbine blade of the related art employing a film cooling hole as described above is deteriorated. In addition, there is the problem in that the inlet 7*a* has a circular cross-sectional surface, such that hoop stress is caused to incur deformation or cracking within the blade due to stress concentration at a specific position.

SUMMARY OF THE DISCLOSURE

Exemplary embodiments of the present invention provide a gas turbine blade that forms a protrusion inside a film cooling hole provided in a gas turbine blade, thus enhancing cooling performance.

According to one aspect of the present invention, a turbine blade for a gas turbine may include an outer surface; and at least one film cooling hole formed in the outer surface, each film cooling hole including a cooling channel extending inside the turbine blade to guide cooling air toward the outer surface, an outlet communicating with one end of the cooling channel to discharge cooling air to the outer surface, and a plurality of protrusions formed on an inside surface of the outlet and arranged along a longitudinal direction of the outlet.

The protrusions may protrude inwardly to a predetermined height from the inside surface of the outlet and extend from the one end of the cooling channel to the outer surface.

The predetermined height may increase in protrusions formed closer to the outer surface.

The protrusions may be arranged so as to radiate outward from a longitudinal center of the outlet, proceeding from the one end of the cooling channel toward the outer surface.

The protrusions may be configured as one of an arrangement of at least one protrusion formed on an inside wall of the outlet and an arrangement of at least one protrusion formed on each of two opposing inside walls of the outlet.

The turbine blade may further include at least one auxiliary protrusion arranged on each of two inside walls of the outlet.

At least one of the protrusions may be formed with a through-hole through which the cooling air is flowed.

The through-hole may have a configuration of one of a substantial alignment parallel to a longitudinal center of the outlet and a substantial alignment perpendicular to the longitudinal center of the outlet.

The turbine blade may further include at least one groove portion arranged adjacent to the protrusions.

The groove portion may be formed in an elliptical shape toward the outlet.

The groove portion may be formed with a guide groove extended to the groove portion from the surface of the outlet in order to guide an internal inflow of the cooling air in the circumferential direction.

The guide groove may be extensively formed from the cooling channel toward the outlet.

The groove portion may include a vortex generation groove formed in a spiral shape in an inside circumferential direction.

The groove portion may further include a guide groove portion formed on an inside center thereof.

The cooling channel may be extended in a circular cylinder shape toward the outlet, and the outlet may have a diffusion angle $\alpha$ toward the outside thereof on a rear end portion of the cooling channel and extended in an elliptical shape.

The at least one film cooling hole may be respectively formed in a pressure surface and in a suction surface of the turbine blade.

The film cooling hole may be located at different intervals in the section from a leading edge to a trailing edge constituting the turbine blade to achieve film cooling.

According to another aspect to the present invention, there is provided a gas turbine including the above turbine blade.

The turbine blade may further include a plurality of unit blades constituting the turbine blade, wherein the at least one film cooling hole is provided on each of a single turbine blade of the plurality of unit blades and on a two-stage turbine blade of the plurality of unit blades.

According to another aspect of the present invention, there is provided a method of producing the above film cooling hole by application to at least one of a turbo device and a turbine device.

The embodiments of the present invention can enhance the heat transfer performance through the plurality of protrusions provided in the outlet and thereby enhance the cooling efficiency for the surface of the turbine blade.

The embodiments of the present invention inflows some of the cooling air passing through the film cooling hole into the groove portion, thus enhancing the cooling performance by performing the cooling in duplicate together with the protrusion.

BRIEF DESCRIPTION OF THE DRAWINGS

FIG. 1 is a diagram of a film cooling hole portion formed in a turbine blade according to a related art.

FIG. 2 is a longitudinal cross-sectional diagram of a gas turbine in which a gas turbine blade of the present invention is installed.

FIG. 3 is a perspective view of a gas turbine blade according to an embodiment of the present invention, including an enlarged perspective view of a film cooling hole of the gas turbine blade.

FIG. 4 is a perspective view of the structure of a film cooling hole of a gas turbine blade according to another embodiment of the present invention.

FIG. 5 is a cross-sectional view of an outlet of a film cooling hole of a gas turbine blade according to an embodiment of the present invention.

FIG. 6 is a perspective of view of a film cooling hole of a gas turbine blade according to another embodiment of the present invention.

FIG. 7 is a perspective of view of a film cooling hole of a gas turbine blade according to another embodiment of the present invention.

FIGS. 8 and 9 are diagrams illustrating the flow of the cooling air moving through a cross-section of the film cooling hole in accordance with an embodiment of the present invention.

FIGS. 10 and 11 are a perspective view and a schematic plan view, respectively, of a film cooling hole of a gas turbine blade according to another embodiment of the present invention.

FIGS. 12 and 13 are schematic diagrams of a film cooling hole of a turbine blade according to another embodiment of the present invention, respectively illustrating alternative arrangements of the protrusion and a groove portion.

FIG. 14 is a diagram illustrating the groove portion and a guide groove in accordance with an embodiment of the present invention.

FIG. 15 is a cross-sectional view of FIG. 14.

FIG. 16 is a perspective view of a groove portion and a protrusion in accordance with another embodiment of the present invention, in which a vortex generation groove is formed in the groove portion.

FIG. 17 is a cross-sectional view of a portion of the outlet of the film cooling hole of a gas turbine blade according to another embodiment of the present invention.

DESCRIPTION OF SPECIFIC EMBODIMENTS

Before explaining the present invention, a configuration of a gas turbine will be described with reference to the drawings.

Referring to FIG. 2, a gas turbine includes a casing 10 giving an external shape to the gas turbine, a compressor section 12 located toward the upstream end of the casing 10, and a turbine section 30 located toward the downstream end. The downstream end of the casing 10 is provided with a diffuser through which a combustion gas passing through the turbine is discharged. A number of combustors 11 that receive and combust the air compressed are located upstream of the diffuser and are arranged around the circumference of the casing 10.

A torque tube 14 that delivers a rotation torque generated in the turbine section 30 to the compressor section 12 is interposed between the compressor section 12 and the turbine section 30.

The compressor section 12 is provided with a plurality (e.g., fourteen) of compressor rotor disks, which are held together in the axial direction by a tie rod 15 having one end fastened in the first compressor rotor disk and the other end fixed to the torque tube. That is, the compressor rotor disks are arranged along the axis direction and each has the tie rod 15 penetrating the center thereof. A flange protrudes in the axis direction and is coupled to prevent the rotation relative to the adjacent rotor disk. The configuration of the tie rod 15 may vary depending upon the gas turbine and is not limited to the configuration illustrated in the drawings. For example, one tie rod may penetrate the central portion of the rotor disks, a plurality of tie rods may be arranged along the circumferential direction, or a combination of these configurations may be used.

A plurality of blades are radially coupled to the outer circumferential surface of the compressor rotor disk. Each blade has a dovetail portion to be fastened to the compressor rotor disk. The fastening method of the dovetail portion includes a tangential type and an axial type. This can be selected depending upon the required structure of the gas turbine commonly used. In some cases, the blade can be fastened to the rotor disk using another fastener other than the dovetail.

Although not shown, the compressor may be may be provided with a vane functioning as a guide vane, called a deswirler, for next location of the diffuser in order to adjust the flowing angle of fluid entering the inlet of the combustor after increasing the pressure of fluid to the design flow angle.

The combustor 11 produces a high-temperature, high-pressure combustion gas of high energy by mixing the incoming compressed air with a fuel and combusting the mixture. The temperature of the combustion gas is generally as high as a heat-resistant limitation that the combustor and turbine parts can withstand in the constant pressure combustion process.

Plural combustors constituting a combustion system of the gas turbine can be arranged in the casing formed in the cell shape, and each combustor is configured to include a burner including a fuel spray nozzle, etc., a combustor liner forming a combustion chamber, and a transition piece becoming a connection portion of the combustor and the turbine.

Specifically, the liner provides a combustion space where the fuel sprayed by a fuel nozzle is mixed with the compressed air of the compressor and combusted. The liner can include a flame barrel providing the combustion space where the fuel mixed with the air is combusted, and a flow sleeve forming an annular space while surrounding the flame barrel. In addition, the fuel nozzle is coupled to the front end of the liner, and an ignition plug is coupled to the side wall thereof.

Meanwhile, the transition piece is connected to the rear end of the liner in order to transmit the combustion gas combusted by the ignition plug to the turbine side.

The transition piece cools the outer wall portion thereof by the compressed air supplied from the compressor in order to prevent combustion gas from being damaged by high temperature.

For this purpose, the transition piece is provided with holes for the cooling to spray the air into the inner portion thereof, and the compressed air is flowed to the liner side after cooling the internal body through the holes.

The cooling air cooling the transition piece described above is flowed in the annular space of the liner. The compressed air can be provided from the outside of the flow sleeve and introduced into the cooling air through the cooling holes provided in the flow sleeve to then collide against the outer wall of the liner.

Meanwhile, generally, the turbine expands the high-temperature, high-pressure combustion gas coming from the combustor and converts it into mechanical energy by applying the impulsive and repulsive force to the rotation wing of the turbine.

The mechanical energy obtained in the turbine is supplied as the energy required for compressing the air in the compressor, and the rest is used to operate a generator to generate the power.

In the turbine, a plurality of stators and rotors are alternatively arranged in the vehicle room, and the rotor is operated by the combustion gas to rotate the output shaft to which the generator is connected.

For this purpose, the turbine section 30 is provided with a plurality of turbine rotor disks, and each of the turbine rotor disks basically has the shape similar to the compressor rotor disk.

The turbine rotor disk also has a flange for coupling with a neighboring turbine rotor disk, and includes a plurality of turbine blades radially located. The turbine blade can be also coupled to the turbine rotor disk in the dovetail method.

In the gas turbine having the above structure, the incoming air is compressed in the compressor section 12, combusted in the combustor 11, then moved to the turbine section 30 to operate the turbine and discharged to the atmosphere through the diffuser.

A representative method for increasing the efficiency of the gas turbine includes increasing the temperature of the gas flowed into the turbine section 30, but in this case, the phenomenon increasing the inlet temperature of the turbine section 30 is caused.

In addition, a problem is caused in the turbine blade provided in the turbine section 30 and the temperature of the turbine blade locally increases to generate thermal stress. If the thermal stress is maintained for a long time, deformation by way of a creep phenomenon can lead to the destruction of the turbine blade.

In order to compensate for the problems generated in the turbine blade described above, the cooling air is supplied to the inside of the turbine blade. The cooling air performs the cooling while flowing along a flow path formed inside the turbine blade.

Hereinafter, a configuration of the present invention will be described with reference to the drawings.

A gas turbine blade in accordance with an embodiment of the present invention will be described with reference to the drawings.

Referring to FIG. 3, the gas turbine blade in accordance with an embodiment of the present invention realizes stable surface cooling (film cooling) when a high-temperature hot gas is applied to surfaces of the turbine blade. In this case, the present invention performs film cooling for an outer surface 36 of a turbine blade 33 through a film cooling hole 100 that can deliver the cooling air, which has been supplied to the inside of the turbine blade 33, to the outer surface of the turbine blade 33.

For this purpose, the present invention is provided with a plurality of film cooling holes 100 formed in an outer surface of the turbine blade 33, from a leading edge 34 to a trailing edge 35 of the turbine blade 33. Although FIG. 3 depicts the turbine blade 33 having a plurality of the film cooling holes 100, the turbine blade 33 of the present invention is essentially provided with at least one film cooling hole 100. The film cooling hole 100 is provided for the cooling air to be supplied from the inside of the turbine blade 33 and then sprayed to the surface thereof to achieve the film cooling.

The turbine blade 33 for a gas turbine includes an outer surface 36 and the at least one film cooling hole 100 formed in the outer surface 36. Each film cooling hole 100 includes a cooling channel 110 extending inside the turbine blade 33 to guide cooling air toward the outer surface 36, an outlet 120 communicating with one end of the cooling channel 110 to discharge cooling air to the outer surface 36, and a plurality of protrusions 130 formed on an inside surface (121, 122, 123, 124) of the outlet 120 and arranged along a longitudinal direction of the outlet 120.

The outlet 120 includes inside walls 121 and 122 that face each other. More specifically, the outlet 120 has an elongated cross-section that extends perpendicularly with respect to the direction of the flow of air across the outer surface 36, which comprises a pressure surface 33*a*, a suction surface 33*b*, and a leading edge 34. In general, the cross-section of the outlet 110 has an oblong shape with two flat sides and two rounded ends, as shown in FIG. 5.

The cooling channel 110 may have a circular cross-section to be generally cylindrical according to an embodiment, but alternatively the cross-section may have an oblong shape with two flat sides and two rounded ends, as shown in FIG. 3. One end of the cooling channel 110 is connected to the inside of the turbine blade 33 so that the cooling air is flowed. The other end of the cooling channel 110 is extended toward the outlet 120 and toward the outside of the turbine blade 33 and is joined with the outlet 120. At the junction of the cooling channel 110 and the outlet 120, the outlet 120 exhibits a diffusion angle $\alpha$ with respect to the cooling channel 110. The diffusion angle $\alpha$ is maintained at an angle of 15 degrees or more, in order to suppress the occurrence of excessive separation phenomenon and to stably guide the cooling air moving along the outlet 120 before reaching the surface of the turbine blade 33. When the range of the diffusion angle $\alpha$ is between 15 and 40 degrees, the cooling channel 110 in accordance with the present embodiment stably guides the flowing of the cooling air in the optimum state for a film cooling effect.

The film cooling hole 100 implements the film cooling for the outer surface 36 of the turbine blade 33 while mixing with a high-temperature hot gas moving along the outer surface 36 of the turbine blade 33. In addition, the film cooling hole 100 implements the cooling by performing heat exchange through the surface area when the cooling air is supplied toward the outlet 120, and reducing a high temperature of the hot gas to a predetermined temperature while being stably diffused toward surfaces of the turbine blade 33.

The protrusion 130 may protrude inwardly from an inside surface of the outlet 120 and may be arranged in a section of the film cooling hole 100 across the outlet 120, extending from an end of the cooling channel 110 to the surface of the turbine blade 33. The protrusion 130 may protrude to a predetermined height that may vary depending upon the diameter of the cooling channel 110. The configuration of the protrusion 130 is not limited to the shapes illustrated in the drawings and may have a circular cross-sectional surface, a polygonal cross-sectional surface, a D-shaped cross-sectional surface, or a combination thereof.

Referring to FIG. 4, the protrusions 130 are positioned within the outlet 120 so as to radiate outward from the longitudinal center of the outlet 120, proceeding from the end of the cooling channel 110 toward the surface of the turbine blade 33, that is, following the direction of the airflow. A main object of the protrusion 130 is to enhance the cooling effect through the heat transfer by the contact with the cooling air, but the fact that the protrusion 130 constantly maintains the flowing of the cooling air is very important.

Particularly, turbulence depending upon the movement of the cooling air is caused in the section from the cooling channel 110 to the outlet 120, and is changed depending upon the arrangement state of the protrusion 130. The present embodiment, as an example, does not arrange the protrusion 130 unevenly, and radially arranges it outward toward the outlet 120 considering the movement stability of the cooling air.

In this case, the flowing of the cooling air is guided as indicated by the arrows even when contacting directly with the protrusion 130 or indirectly contacting therewith.

Particularly, the cooling air is stably moved to the surface of the turbine blade 33 through the outlet 120 if the heat transfer due to the contact with the protrusion 130 and the movement to a neighboring protrusion 130 are stably performed.

Accordingly, the present embodiment can simultaneously enhance the flowing stability of the cooling air moving to the outlet 120 and the heat transfer with the protrusion 130, thus enhancing overall cooling efficiency for the turbine blade 33.

Referring to FIG. 5, in the present embodiment, the protrusion 130 may be variously configured, to include an arrangement whereby one or more protrusions 130 are formed on at least one inside surface of the film cooling hole 100. That is, the protrusions 130 may be formed on one or the other of first and second inside walls 123 and 124, or on both the first and second inside walls 123 and 124 to face each other within the outlet 120. However, it is possible to achieve optimum cooling efficiency when the protrusion 130 is formed on just one inside wall.

For example, if the protrusions 130 are located on both the first and second inside walls 123 and 124, the flow rate of the cooling air is reduced, but the cooling efficiency of the film cooling hole 100 is enhanced by the heat transfer. In this case, it is preferable that the film cooling hole 100 is formed at the location where the cooling air is not required to spread to the surface of the turbine blade 33 with a rapid flow rate thereof. For example, it is preferable that it is formed in the area excluding the leading edge 34.

FIG. 6 shows the film cooling hole 100 according to another embodiment of the present invention, in which an auxiliary protrusion is provided in addition to the protrusion 130.

Referring to FIG. 6, the film cooling hole 100 further includes at least one auxiliary protrusion **130*a* arranged along one or both opposing inside walls 121 and 122 of the outlet 120. In conjunction with the protrusion 130, the auxiliary protrusion 130*a* achieves a cooling efficiency enhancement of the film cooling hole 100 through the heat transfer with the cooling air traveling over the inside walls 121 and 122. The auxiliary protrusion 130*a* is formed to be smaller than the protrusion 130, and as an example, may be 30% smaller than the protrusion 130, to minimize the separation phenomenon upon contacting with the cooling air and to simultaneously enhance the movement stability depending upon the movement to the outlet 120**.

FIG. 7 shows the film cooling hole 100 according to another embodiment of the present invention, illustrating an alternative arrangement of the protrusions 130.

Referring to FIG. 7, the protruded height of the protrusion 130 increases toward the surface of the turbine blade 33, that is, in the direction of the flow of cooling air through the outlet 120. The configuration serves to stably move the cooling air from the cooling channel 110 and through the outlet 120. In this case, since the cooling air has a low resistance even when directly contacting the protrusion 130 right after passing through the cooling channel 110, the configuration is advantageous in moving the cooling air to the surface of the turbine blade 33. In addition, since the surface area of the protrusion 130 is increased to also enhance the cooling efficiency, it is possible to achieve the cooling efficiency enhancement of the film cooling hole 100.

Referring to FIGS. 8 and 9, most preferably, the cooling air is flowed uniformly when moving from the internal area of the outlet 120, but since the flow rate of the cooling air is kept close to zero near the inside walls 121 and 122 of the outlet 120, a difference between the flow rate and the viscosity of the cooling air moving to the inside walls 121 and 122 and the flow rate and the viscosity of the cooling air moving along the width directional center is caused.

Due to different flow rates of the cooling air, the cooling air moving along the width directional center does not move directly toward the front from the inside of the outlet 120 and moves toward the inside walls 121 and 122, such that the flow rate is relatively slow and thereby the separation phenomenon can be caused. The present invention includes an auxiliary protrusion **130*a* in order to minimize the separation phenomenon. As the cooling air contacts the auxiliary protrusion 130*a*, an eddy is caused. The eddy phenomenon, i.e., a small amount of swirling airflow, can prevent the separation caused by the cooling air moving along the inside walls 121 and 122, thus achieving a stable movement of the cooling air. By stably moving the cooling air to the surface of the turbine blade 33 through the outlet 120, it is possible to enhance the heat transfer efficiency and to achieve overall cooling performance enhancement for the turbine blade 33**.

The eddy phenomenon causes small swirling in the cooling air in the inside walls 121 and 122 unlike the separation phenomenon causing a considerably large swirling flow in the cooling air. The swirling guides the flowing direction of the cooling air to the width directional center of the outlet 120 in the shape illustrated in the drawings in the inside walls 121 and 122, rather than the flowing affecting overall flowing of the cooling air. Particularly, it can be seen that the cooling air causes small swirling near the auxiliary protrusion 130*a*, and the level of the swirling is weakened between the auxiliary protrusions 130*a* spaced apart from each other.

The film cooling hole 100 in accordance with the present embodiment is located on the pressure surface 33*a* and the suction surface 33*b* of the turbine blade 33, respectively, and the location corresponds to the location where the high-temperature hot gas moves along the surface of the turbine blade 33. That is, the cooling air on the pressure surface 33*a* and the suction surface 33*b* moves along the surface of the turbine blade 33 as indicated by the arrows in FIG. 3, and the film cooling effect is stably maintained, thus achieving the film cooling of the turbine blade 33.

As an example, in the present embodiment, the film cooling hole 100 is located at different intervals in the section from the leading edge 34 to the trailing edge 35 constituting the turbine blade 33, thus achieving the film cooling.

The film cooling hole 100 is concentrated in plural in the section maintained at a high temperature on the pressure surface 33*a* and the suction surface 33*b* of the turbine blade 33, and the number of location can be reduced in the section maintained at a relatively low temperature.

The film cooling hole 100 is provided in a single turbine blade and a two-stage turbine blade of a plurality of unit blades constituting the turbine blade 33, respectively, and the single and two-stage turbine blades correspond to the location where the direct or indirect contact with the high-temperature hot gas is made through the combustor.

In this case, the cooling state can be changed depending upon the movement trajectory and the temperature distribution of the hot gas moving along the pressure surface 33*a* and the suction surface 33*b*, but the present embodiment, as an example, changes a location interval or distribution on the pressure surface 33*a* and the suction surface 33*b* to enhance the film cooling effect for the surface of the turbine blade 33.

Accordingly, since the turbine blade 33 enhances the film cooling effect for the surface contacting with the high-temperature hot gas, the deformation can be prevented even during a long term use.

Referring to FIGS. 10 and 11, the protrusion 130 can be formed with a through-hole 131 so that the cooling air is supplied to the plurality of protrusions 130. The present embodiment forms the through-hole 131 in at least one of the protrusions 130 to guide the movement direction of the cooling air and thereby, simultaneously achieves the enhancement of the stable flowing and the heat transfer performance of the cooling air.

The protrusion 130 in accordance with the present embodiment is opened so that the through-hole 131 faces the outlet 120. For reference, the opened area of the through-hole 131 can be opened as an optimized size through the separate simulation or the flowing analysis. In this case, since the resistance due to the movement of the cooling air is reduced, a large amount of cooling air can be more stably supplied to the surface of the turbine blade 33.

The through-hole 131 in accordance with the present embodiment can be opened toward the outlet 120 or the inside walls 121 and 122 of the outlet 120. In this case, since some cooling air are moved in the diffused state toward the inside walls 121 and 122, a greater amount of cooling air is moved toward the inside walls 121 and 122 compared to the through-hole having a constant size. Accordingly, the heat transfer efficiency on the inside walls 121 and 122 can be enhanced to achieve the cooling performance enhancement of the turbine blade.

FIGS. 12 and 13 respectively show alternative arrangements of groove portions 140 provided in the outlet 120 of the film cooling hole 100 of the turbine blade 33 according to another embodiment of the present invention.

Referring to FIGS. 12 and 13, in the present embodiment, at least one groove portion 140 in the section from the cooling channel 110 to the outlet 120 is provided adjacent to the above-described protrusion 130. For example, the groove portions 140 may be arranged in alignment with the protrusions 130 to be positioned on either side of each protrusion 130, as in FIG. 12, or the groove portions 140 may be arranged in rows positioned on opposite sides of a central row of protrusions 130 to extend increasingly away from the protrusions 130 in the airflow direction, as in FIG. 13.

The groove portion 140 is formed to inflow some cooling air into the inside thereof to achieve the cooling efficiency enhancement through the heat transfer, and the number and location thereof is not limited to the form illustrated in the drawings but can be variously changed. As an example, the groove portion 140 may be located for each protrusion 130, or can be located to be spaced apart from the protrusion 130. The groove portion 140, as an example, may be elliptical or oval in shape and arranged lengthwise toward the outlet 120. The length and width of the groove portion 140 is not specially limited.

Referring to FIGS. 14 and 15, the groove portion 140 is formed with at least one guide groove 142 extended from the surface of the outlet 120 to the groove portion 140 in order to guide the internal inflow of the cooling air in the circumferential direction.

The guide groove 142 guides some cooling air to the groove portion 140 considering the difficulty of the cooling air to be directly moved toward the inside region of the groove portion 140.

The cooling air guided to the guide groove 142 causes the movement flowing in the form of a vortex in the inside region of the groove portion 140 to retain some cooling air inside the groove portion 140 for a predetermined time.

The cooling air is not directly moved from the groove portion 140 toward the outlet 120 and flows in a spiral shape or a swirling shape, such that the heat transfer due to the contact is performed.

In the present embodiment, the cooling by the protrusion 130 and the cooling by the groove portion 140 are performed in duplicate to enhance the cooling performance in the limited region, and as a result, it is possible to enhance the cooling efficiency of the film cooling hole 100, thus efficiently performing the cooling for the turbine blade 33.

The guide groove 142 is located from the cooling channel 110 toward the outlet 120 based on the movement direction of the cooling air and the drawings. The guide groove 142 may be variously configured to have a circular, polygonal, or elliptical cross-section among other shapes.

As an example, since the guide groove 142 is located at the side location of the groove portion 140, the cooling air flowed to the groove portion 140 causes the movement of the spiral shape at the side surface thereof.

FIG. 16 shows the protrusion 130 juxtaposed with the groove portion 140 having a vortex generation groove in accordance with another embodiment of the present invention.

Referring to FIG. 16, the groove portion 140 includes a vortex generation groove 144 formed as a spiral pattern around the substantial center of the bottom of the groove portion 140. The vortex generation groove 144 guides the movement direction of the cooling air flowed to the groove portion 140 and guides to prevent the cooling air from immediately exiting the groove portion 140 to move the cooling air along the vortex generation groove 144 for a certain time, thus achieving the cooling due to the heat transfer.

FIG. 17 shows the outlet 120 of the film cooling hole 100 of a turbine blade 33 according to another embodiment of the present invention, in which the groove portion 140 is provided with a guide groove portion.

Referring to FIG. 17, the groove portion 140 further includes a guide groove portion 146 formed in the bottom of the groove portion 140 substantially at its center. The guide groove portion 146 may be variously configured and may have a circular or elliptical cross-section, or be alternatively formed as other shapes. The guide groove portion 146 can prevent some of the incoming cooling air from immediately exiting the groove portion 140, by inducing the cooling air to stay inside the groove portion 140 for a certain time after entry, thus achieving a cooling performance enhancement due to increased heat transfer at the corresponding location. Since the guide groove portion 146 is located toward the exiting end of the outlet 120, the cooling effects by cooling air being moved to the surface of the turbine blade 33 and by a cooling achieved by the guide groove portion 146 are added, thus achieving more efficient cooling.

Accordingly, a plurality of turbine blades 33 can enhance the cooling efficiency through the cooling by the protrusion 130 and the cooling by the groove portion 140 and the guide groove portion 146, and can improve stability of the turbine during long-term operation.

A gas turbine provided with the film cooling hole 100 on the turbine blade 33 in accordance with the present invention is also provided. The gas turbine includes a compressor, a combustor, and a turbine with the turbine blade 33 provided with the film cooling hole 100. Cooling for the turbine blade 33 is stably performed by the configurations and the effects of the above-described protrusion 130.

The present embodiment can provide a method of producing the film cooling hole 100 by applying it to one or both of a turbo device and a turbine device.

What is claimed is:

1. A turbine blade for a gas turbine, comprising:

an outer surface; and at least one film cooling hole formed in the outer surface, each film cooling hole including a cooling channel extending inside the turbine blade to guide cooling air toward the outer surface, an outlet communicating with one end of the cooling channel to discharge cooling air to the outer surface, and a plurality of protrusions formed on an inside surface of the outlet and arranged along a longitudinal direction of the outlet, wherein at least one of the protrusions is formed with a through-hole through which the cooling air is flowed.

2. The turbine blade of claim 1, wherein the protrusions protrude inwardly to a predetermined height from the inside surface of the outlet and extend from the one end of the cooling channel to the outer surface.

3. The turbine blade of claim 2, wherein the predetermined height increases in protrusions formed closer to the outer surface.

4. The turbine blade of claim 1, wherein the protrusions are arranged so as to radiate outward from a longitudinal center of the outlet, proceeding from the one end of the cooling channel toward the outer surface.

5. The turbine blade of claim 1, wherein the protrusions are configured as one of an arrangement of at least one protrusion formed on an inside wall of the outlet and an arrangement of at least one protrusion formed on each of two opposing inside walls of the outlet.

6. The turbine blade of claim 1, further comprising at least one auxiliary protrusion arranged on each of two inside walls of the outlet.

7. The turbine blade of claim 1, wherein the through-hole has a configuration of one of a substantial alignment parallel to a longitudinal center of the outlet and a substantial alignment perpendicular to the longitudinal center of the outlet.

8. The turbine blade of claim 1, further comprising at least one groove portion arranged adjacent to the protrusions.

9. The turbine blade of claim 8, wherein the groove portion is formed in an elliptical shape toward the outlet.

10. The turbine blade of claim 8, wherein the groove portion is formed with a guide groove extended to the groove portion from the surface of the outlet in order to guide an internal inflow of the cooling air in the circumferential direction.

11. The turbine blade of claim 10, wherein the guide groove is extensively formed from the cooling channel toward the outlet.

12. The turbine blade of claim 8, wherein the groove portion includes a vortex generation groove formed in a spiral shape in an inside circumferential direction.

13. The turbine blade of claim 8, wherein the groove portion further includes a guide groove portion formed on an inside center thereof.

14. The turbine blade of claim 1, wherein the cooling channel is extended in a circular cylinder shape toward the outlet, and the outlet has a diffusion angle $\alpha$ toward the outside thereof on a rear end portion of the cooling channel and extended in an oblong shape.

15. The turbine blade of claim 1, wherein the at least one film cooling hole is respectively formed in a pressure surface and in a suction surface of the turbine blade.

16. The turbine blade of claim 1, wherein the film cooling hole is located at different intervals in the section from a leading edge to a trailing edge constituting the turbine blade to achieve film cooling.

17. The turbine blade of claim 1, wherein a film cooling portion is included in the turbine blade.

18. The turbine blade of claim 1, wherein the turbine blade comprises a plurality of unit blades, and the at least one film cooling hole is formed on each of first unit blade and second unit blade.

* * * * *